US011374297B2

(12) United States Patent
Deleniv et al.

(10) Patent No.: US 11,374,297 B2
(45) Date of Patent: Jun. 28, 2022

(54) FILTER ARRANGEMENT

(71) Applicant: Telefonaktiebolaget LM Ericsson (publ), Stockholm (SE)

(72) Inventors: Anatoli Deleniv, Mölndal (SE); Ola Tageman, Gothenburg (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 17 days.

(21) Appl. No.: 16/754,056

(22) PCT Filed: Oct. 18, 2017

(86) PCT No.: PCT/EP2017/076648

§ 371 (c)(1),
(2) Date: Apr. 6, 2020

(87) PCT Pub. No.: WO2019/076456

PCT Pub. Date: Apr. 25, 2019

(65) Prior Publication Data

US 2020/0328490 A1 Oct. 15, 2020

(51) Int. Cl.
*H01P 1/208* (2006.01)
*H01P 7/06* (2006.01)
(Continued)

(52) U.S. Cl.
CPC ..... *H01P 1/2088* (2013.01); *H01P 7/06* (2013.01); *H01Q 15/24* (2013.01); *H01Q 19/005* (2013.01); *H01Q 21/005* (2013.01)

(58) Field of Classification Search
CPC ..... H01P 1/2088; H01P 7/06; H01Q 15/24; H01Q 19/005; H01Q 21/005
See application file for complete search history.

(56) References Cited

U.S. PATENT DOCUMENTS 5,179,363 A 1/1993 Schwartz
5,191,305 A 3/1993 Frost et al.
(Continued)

FOREIGN PATENT DOCUMENTS

CN 1643458 A 7/2005
CN 204481098 U 7/2015
(Continued)

OTHER PUBLICATIONS

Chinese Office Action and Summary English Language Translation dated Feb. 2, 2021 for Application No. 201780096020.5, consisting of 12-pages.
(Continued)

*Primary Examiner* — Stephen E. Jones
*Assistant Examiner* — Kimberly E Glenn
(74) *Attorney, Agent, or Firm* — Christopher & Weisberg, P.A.

(57) ABSTRACT

A filter arrangement having three or more stacked metallization layers separated by printed circuit board, PCB, layers. Each metallization layer includes an aperture. The filter arrangement has a plurality of via-holes extending though the stacked metallization layers and through the separating Dielectric material layers, whereby the via-holes and the metallization layers delimit a cavity in each Dielectric material layer. The cavities in two consecutive Dielectric material layers being coupled by the aperture in the single metallization layer separating the two consecutive Dielectric material layers. The aperture of a topmost metallization layer being arranged as antenna element. The filter arrangement having a signal interface arranged as a conduit connecting at least one dielectric material layer to an exterior of the filter arrangement.

19 Claims, 14 Drawing Sheets

(51) Int. Cl.

| | |
|---|---|
| ***H01Q 15/24*** | (2006.01) |
| ***H01Q 19/00*** | (2006.01) |
| ***H01Q 21/00*** | (2006.01) |

(56) References Cited

U.S. PATENT DOCUMENTS

| | | | | |
|---|---|---|---|---|
| 5,517,203 | A | 5/1996 | Fiedziuszko | |
| 6,020,800 | A | 2/2000 | Arakawa et al. | |
| 10,056,922 | B1 * | 8/2018 | Tsvelykh | H01P 1/20345 |
| 2008/0278259 | A1 | 11/2008 | Ni | |
| 2014/0198004 | A1 | 7/2014 | Richards et al. | |

FOREIGN PATENT DOCUMENTS

| | | | |
|---|---|---|---|
| CN | 106025463 | A | 10/2016 |
| EP | 0874414 | A2 | 10/1998 |
| FR | 2755544 | A1 | 5/1998 |

OTHER PUBLICATIONS

International Search Report and Written Opinion dated Jul. 13, 2018 for International Application No. PCT/EP2017/076648 filed on Oct. 18, 2017, consisting of 11-pages.

Curtis and Fiedziuszko; Multi-layered Planar Filters Based on Aperture Coupled, Dual Mode Micorstrip or Stripline Resonators; Spce Systems/Loral; Palo Alto, California; 1992 IEEE MTT-S Digest, consisting of 4-pages.

Montiel, et al. A Novel Active Antenna with Self-Mixing and Wideband Varactor-Tuning Capabilities for Communication and Vehicle Identification Applications; IEEE Transactions Microwave Theory and Techniques, vol. 44, No. 12; Dec. 1996, consisting of 10-pages.

EPO Communication dated Jul. 30, 2021 for Patent Application No. 17786905.4, consisting of 7-pages.

Chinese Office Action with English Summary Translation dated Aug. 12, 2021 for Patent Application No. 201780096020.5, consisting of 6-pages.

* cited by examiner (a)

(b)

(a)

(b)

FILTER ARRANGEMENT

CROSS-REFERENCE TO RELATED APPLICATIONS

This application is a Submission Under 35 U.S.C. § 371 for U.S. National Stage Patent Application of International Application Number: PCT/EP2017/076648, filed Oct. 18, 2017 entitled "A FILTER ARRANGEMENT," the entirety of which is incorporated herein by reference.

TECHNICAL FIELD

The present disclosure relates to a filter arrangement with metallization layers separated by dielectric material layers. The filter arrangement can be integrated with an antenna element for use in wireless devices.

BACKGROUND

Antenna elements are devices configured to emit and/or to receive electromagnetic signals such as radio frequency (RF) signals used for wireless communication. Phased antenna arrays are antennas comprising a plurality of antenna elements, by which an antenna radiation pattern can be controlled by changing relative phases and amplitudes of signals fed to the different antenna elements.

Practical implementation of signal filtering functions for such antenna elements is a challenging task. High Q-values, multiple resonators, and high precision is required to achieve filters with low loss and strong suppression of frequencies near the operation band where interference or leakage of radio frequency (RF) power may occur. Microstrips and slot resonators are sometimes used to construct filters for antenna elements. However, low Q-factors of the microstrip or slot resonators cause an increased level of insertion loss. Also, traditional filters are typically designed as if they were isolated, which leads to a reduction of the antenna element bandwidth and a modification of the suppression characteristic due to interaction with the antenna.

Footprint is an important factor to consider as antenna arrays grow in number of antenna elements. If the filter components have large footprints, it gets difficult to stay close to the ideal half-wavelength pitch needed to avoid grating lobes, and the size of antenna arrays may become prohibitively large. Furthermore, one must fit two filters for each antenna element if dual polarization is required.

Cost is also important when designing antenna elements for use in arrays. Since arrays may comprise hundreds of antenna elements, individual antenna element cost significantly contributes to the total cost of producing the antenna array.

Integration and assembly aspects must also be considered. If is for example difficult to fit separate filters in the form of SMT-components (pick-and place and reflow soldering), since there is no place to put them with antennas on one side of a circuit board and active circuits on the other side.

Signal integrity aspects also limit the possibilities since one cannot bring signals far apart and since it is difficult to fit sufficient amount of ground connections in the small unit cell defined by the antenna.

Consequently, there is a need for improved filter arrangements for use with antenna elements.

SUMMARY

An object of the present disclosure is to provide at least filter arrangements, antenna elements, antenna arrays, and methods which seek to mitigate, alleviate, or eliminate one or more of the above-identified deficiencies in the art and disadvantages singly or in any combination and to provide improved filter arrangements, antenna elements, antenna arrays, and methods.

This object is obtained by a filter arrangement comprising three or more metallization layers separated by dielectric material layers and an electromagnetically shielded side wall extending though the stacked metallization layers and through the dielectric material layers, whereby the side wall and the metallization layers delimit a cavity in each dielectric material layer. The cavities in two consecutive dielectric material layers being coupled by one or more apertures in the metallization layer separating the two consecutive dielectric material layers. An aperture of a topmost metallization layer is arranged as antenna element. Alternatively, a patch in the topmost metallization layer can be used as the antenna element, or a combination of the two, with a patch surrounded by an aperture. The filter arrangement comprises a signal interface arranged as a conduit connecting at least one dielectric material layer to an exterior of the filter arrangement.

There are a number of advantages associated with the disclosed filter arrangement;

The filter is realizable with compact size, since the filter arrangement shares the same footprint as the antenna element. Each cavity acts as a resonator, which resonators are realized in multiple layers underneath the antenna element. The whole chain of antenna element and filter resonators can be co-designed and made into a single part (although there can optionally be many such parts side by side), thereby avoiding uncontrolled combination effects between filter and antenna element. There is a freedom to use the antenna element/resonator as one of the filter resonators for a compact design, or alternatively to tune the antenna element/resonator for wider passband than the filter, in order to reduce sensitivity in the filter to external conditions such as surrounding structures, element coupling and steering angle dependence.

Good discrimination is possible to achieve, since many cavities can be stacked on top of each other.

Insertion loss is reduced, since the filter and antenna are combined and co-designed, such that at least one of the resonances of the antenna is used as a resonator in the filter arrangement. Surface integrated waveguides have higher Q-factor in comparison to traditionally used microstrip or slot resonators. Further increases in Q-factor is achieved due to use of higher order mode TE210/TE120.

The cost of the filter antenna combination is reduced since standard, low cost, PCB-technologies can be used for implementation.

There is a reduced sensitivity to the manufacturing tolerances, since every over-moded resonant cavity has maximum allowed size, that is defined by that of the antenna unit cell.

The filter antenna combination has a stable frequency response, since the resonant frequency of each cavity TE210/TE120 is at least partly defined by the placement of the side walls, which is a large geometric feature. In the proposed filter-antenna design all the resonators can use the same side wall structure, and can thus be made in one and the same process step for all cavities, to simplify production and improve precision. It follows that the effect of tolerances will be identical for every resonator. Practical importance of this is that the filter-antenna frequency response will be shifted upwards or downwards in frequency, while return loss performance should not be affected much.

Using the antenna element as one of the filter resonators provides a simple way to achieve wide frequency range. In this case the filter works as a matching circuit for antenna element.

According to aspects, the aperture of a bottommost metallization layer is arranged as signal interface to the filter arrangement. This provides for a straight forward interfacing with the filter arrangement.

According to some aspects, the side wall comprises a signal interface arranged as a conduit connecting at least one dielectric material layer to an exterior of the filter arrangement. When interfacing with the filter arrangement via the side wall, middle layers in the stack are accessible. This interface enables filter arrangement with transmission zeros in the frequency response characteristics, which is an advantage.

According to other aspects, the signal interface comprises a plurality of signal ports arranged to input and to output signals to and from the filter arrangement. For instance, the filter arrangement can support two orthogonally polarized signals at the same time, which is an advantage.

According to further aspects, the apertures of two consecutive metallization layers have a centered cross shape, and a shape with four slots arranged in a square, respectively. This arrangement of alternating between centered cross slots and four peripheral slots suppresses long-ranged coupling between cavities, which is an advantage.

According to aspects, at least one dielectric material layer comprises two or more dielectric sublayers and a metal patch arranged between two of the dielectric sublayers, whereby the dielectric sublayers and the metal patch together determine an effective dielectric constant of the at least one dielectric material layer. The metal patch allows for fine-grained tuning of resonance frequency, which is an advantage.

There are also disclosed herein antenna elements and wireless devices comprising the filter arrangements discussed above.

There is also disclosed herein methods for receiving a radio signal from a remote transmitter and filtering the radio signal, comprising configuring a filter arrangement comprising three or more metallization layers separated by dielectric material layers, each metallization layer comprising an aperture, the filter arrangement comprising an electromagnetically shielded side wall extending though the metallization layers and through the dielectric material layers, whereby the side wall and the metallization layers delimit a cavity in each dielectric material layer, the cavities in two consecutive dielectric material layers being coupled by the aperture in the single metallization layer separating the two consecutive dielectric material layers, receiving the radio signal via the aperture of a topmost metallization layer, filtering the received radio signal by the coupled cavities, and outputting a filtered radio signal via the aperture of a bottommost layer being arranged as signal interface to the filter arrangement.

There is furthermore disclosed herein methods for filtering a radio signal and transmitting the radio signal to a remote receiver, comprising configuring a filter arrangement comprising three or more metallization layers separated by dielectric material layers, each metallization layer comprising an aperture, the filter arrangement comprising an electromagnetically shielded side wall extending though the metallization layers and through the dielectric material layers, whereby the electromagnetically shielded side wall and the metallization layers delimit a cavity in each dielectric material layer, the cavities in two consecutive dielectric material layers being coupled by the aperture in the single metallization layer separating the two consecutive dielectric material layers, inputting a radio signal via the aperture of a bottommost layer being arranged as signal interface to the filter arrangement, filtering the inputted radio signal by the coupled cavities, and transmitting the filtered radio signal via the aperture of a topmost metallization layer.

The antenna elements, wireless devices, and methods display advantages corresponding to the advantages already described in relation to the filter arrangements.

BRIEF DESCRIPTION OF THE DRAWINGS

Further objects, features, and advantages of the present disclosure will appear from the following detailed description, wherein some aspects of the disclosure will be described in more detail with reference to the accompanying drawings, in which.

DETAILED DESCRIPTION

Using PCB technology resonance cavities may be realized by electromagnetically shielding a section of a PCB. By connecting a number of such resonance cavities together by apertures or openings in the shielding, a filtering function can be obtained in PCB material. An aperture of a topmost metallization layer can be configured as antenna element. This way a filter and antenna element can be integrated, and will share the same footprint on a PCB.

Herein, an integrated filter-antenna arrangement is proposed that provides both filtering and broadband matching functions for the antenna element. The type of the resonators utilized for the filter are TE201 and TE102 modes of a substrate integrated waveguide or substrate integrated cavity. These have much better Q-factor and lower sensitivity toward manufacturing tolerances than traditional design component used in filters for antenna functions. By using TE201 and TE102 degeneracy, it is also possible to support two orthogonal polarizations in one antenna and filter without increase of the filter-antenna footprint.

Implementation of a filter using a plurality of resonance cavities requires adjustment of the resonance frequencies of the cavities. Parameters that affect the resonance frequency of a TEmn0 resonance cavity include permittivity of the PCB material and its size. However, PCB materials are often only available in certain pre-determined permittivity values. Thus, for a fixed dimension of the electromagnetical shielding, the flexibility of tuning TEmn0 resonance cavities become limited to available selectable permittivities. If a material with the desired permittivity is not available, the size of the electromagnetical shielding must be altered to change resonance frequency, which makes it difficult to find a common size for the cavities and of course changes footprint. However, by introduction of a metal patch sandwiched between PCB layers of different permittivity, a fine tuning of resonance frequency can be performed.

Figure 1:
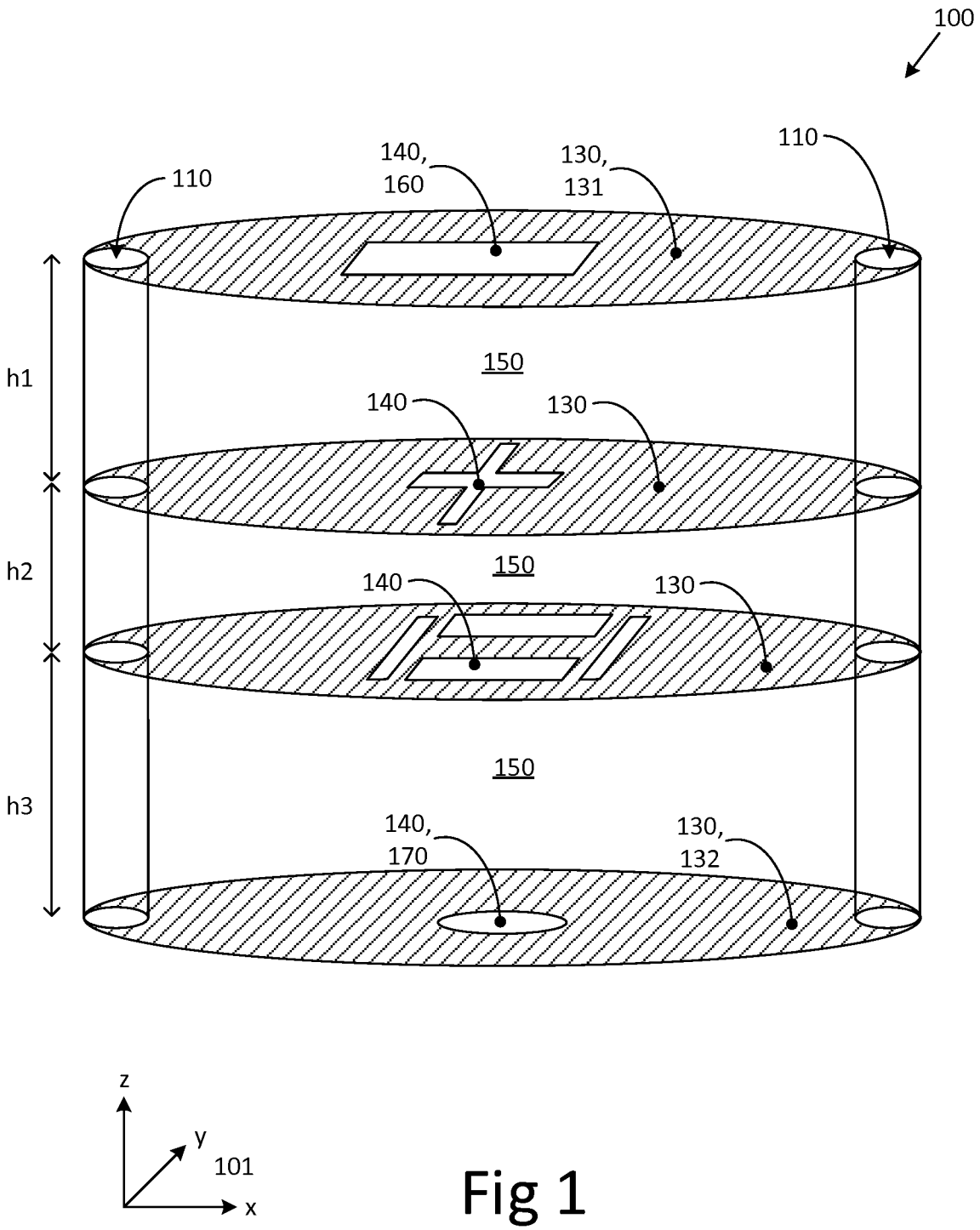
FIGS. 1-3 illustrate filter arrangements according to embodiments.

FIG. 1 illustrates a filter arrangement 100 comprising three or more metallization layers 130 separated by dielectric material layers 150. An electromagnetically shielded side wall 110 extends though the stacked metallization layers and through the dielectric material layers, whereby the side wall and the metallization layers delimit a cavity in each dielectric material layer. The cavities in two consecutive dielectric material layers, i.e., neighboring layers in the stack, are coupled, or connected, by one or more apertures 140 in the metallization layer separating the two consecutive dielectric material layers, an aperture of a topmost metallization layer 131 is arranged as antenna element 160. The filter arrangement also comprises a signal interface 170 arranged as a conduit connecting at least one dielectric material layer to an exterior of the filter arrangement. Aspects of the signal interface 170 will be discussed in more detail in connection to FIG. 7.

That two layers are coupled means that they are arranged to interact directly electromagnetically. According to aspects the coupling is achieved by means of an opening in the metallization layer through which an electromagnetic field may traverse from one cavity into another cavity. However, it is appreciated that said coupling or aperture can be implemented in alternative ways, e.g., by means of microstrip, waveguide, or electrical conduit connecting cavities. It is appreciated that an aperture is a component or structure which allows electromagnetic signals to traverse the aperture from one side to another, i.e., an opening, an electrical conduit, a waveguide, and the like.

The resonance cavities formed by the dielectric material layers, exemplified in, e.g., FIG. 1, are stacked, and together make a multi-layer stack. Herein, a stack is taken to mean a plurality of objects disposed sequentially in connection to each other.

The antenna element 160 is, according to aspects, realized by an opening in the topmost metallization layer, i.e., an aperture in the topmost metallization layer.

The antenna element 160 is, according to other aspects, realized as a patch in the topmost metallization layer placed above an aperture in the second metal layer. There can be an aperture in a ground plane surrounding such a patch.

The antenna element 160 is, according to further aspects, realized by a conduit extending from one of the cavities and arranged to emit and/or to receive radio frequency signals to and from a remote radio transceiver. It is noted that the conduit need not necessarily extend from a bottommost, or from a topmost, PCB layer in the PCB stack.

According to some aspects, the aperture of a bottommost metallization layer 132 is arranged as signal interface 170 to the filter arrangement. Thus, a system may interface with the filter arrangement via one or more conduits in the bottommost metallization layer. The signal interface may be used to transmit and/or to receive radio frequency signals to and from the filter arrangement.

Naturally, an aperture of a topmost metallization layer 131 may also be arranged as signal interface 170 to the filter arrangement.

At least one resonance cavity of the filter arrangement 100 may, according to some aspects, support two TE201 or TE102 degenerate resonance modes. These are degenerate modes that have identical resonance frequencies and field patterns with 90 deg rotational symmetry. TE210 or TE120 degeneracy allows a simple way to realize two independent filtering paths for vertically and horizontally polarized signals. It is, however, advantageous to keep a 90 degree rotational symmetry of the coupling apertures to maintain good isolation between two signal paths.

According to some other aspects, the apertures of two consecutive metallization layers have a centered cross shape 410, and a shape with four slots arranged in a square 430, respectively. This particular arrangement of apertures has an effect of reducing coupling between non-neighboring cavities, i.e., more long-range coupling, which is an advantage.

There are several advantages associated with the filter arrangement shown in FIG. 1, as will now be elaborated upon. The filter arrangement comprises an antenna element, i.e., the antenna element is integrated with the filter arrangement. The footprint of the filter is identical to that of the antenna element, and the filter function and antenna function shares the same footprint on a PCB. This means that the design is more compact than a design with an antenna element connected to a separate filtering arrangement laid out next to the antenna element on a PCB.

The filter arrangement has lower insertion loss compared to more traditional designs. The resonance cavities realized using this type of multilayered substrate stack have higher Q-factors in comparison to other resonators based on microstrips, stripline, slot-lines, and the like. Using higher order filtering structures allows even higher Q-factors to be achieved, often by a price of reduced spurious-free window. However, with proper choice of the coupling arrangement between resonance cavities, there is good potential to keep parasitic passbands at a low level.

By the present filter arrangement, a reduced sensitivity to manufacturing tolerances is also achieved by choosing a maximum size for the resonant cavities overmoded cavity. These have maximum allowable size and hence are less sensitive in comparison to any other implementation of the resonator. It is appreciated that sensitivity of the resonator due to manufacturing tolerances depends on normalized accuracy of the cavity size, hence for a half-size cavity the sensitivity will double for the same level of tolerances.

Furthermore, the resonant frequency of each cavity TE210/TE120 is defined by its dimensions in an x-y plane 101 as shown in FIG. 1, i.e., it is defined by accurate placement of the electromagnetically shielded side wall. In the proposed filter arrangement, all the resonators are using the same electromagnetically shielded side wall. In that follows, e.g., that the effect of inaccurate placement of via holes is identical or very similar for all the resonators. A practical importance of this fact is that the filter-antenna response due to inaccurately placed via holes will be shifted upward or downward in frequency, while return loss performance will be not affected.

Figure 2:
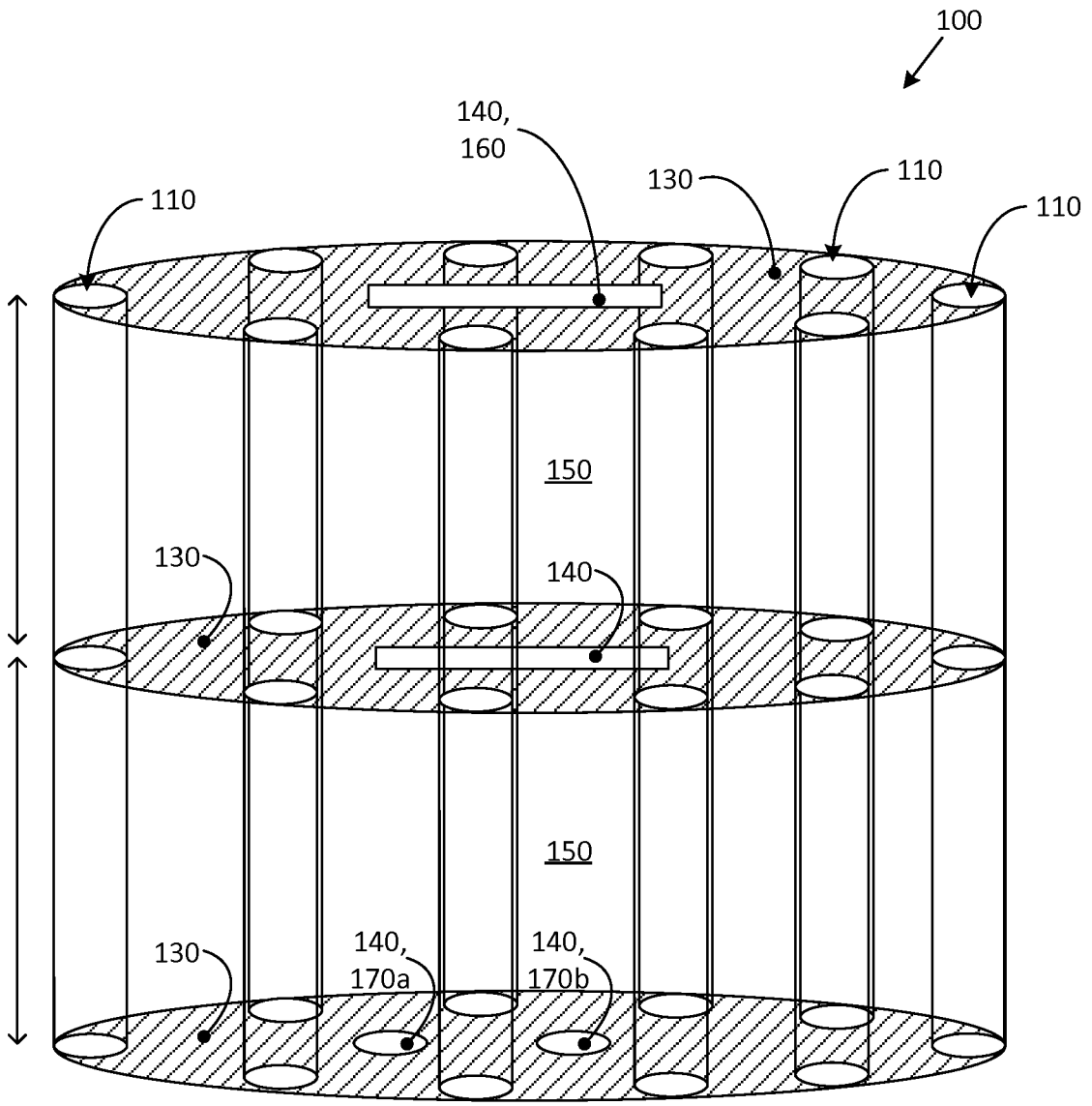

By using the proposed design, large bandwidth antenna elements may be realized. One way to achieve a wide frequency range of operation is to use a cavity backed antenna element as the last resonator in the stack with the load for the filter realized in the PCB substrate stack. The design procedure is standard and in this case the filter works as a matching circuit for the antenna element. This allows great flexibility when choosing the antenna bandwidth and allows a designer to consider the effect of manufacturing tolerances FIG. 2 illustrates a filter arrangement where via holes are used as the electromagnetically shielded side wall 110. Furthermore, FIG. 2 shows a filter arrangement with two ports 170*a*, 170*b*, in the signal interface. In general, the filter arrangement may comprise any number of signal interfaces, with any of the signal interfaces comprising any number of signal ports.

According to aspects, a geometry of the filter arrangement exhibits a 90-degree rotational symmetry, and the signal interface 170 comprises a horizontally polarized 171*a* and a vertically polarized 171*b* signal port. It is appreciated that the filter arrangement rotational symmetry does not have to be exactly 90 degrees to provide support for orthogonal polarizations. It is furthermore appreciated that the center frequencies of vertically and horizontally polarized signals do not need to be identical, but may differ by an amount. Such frequency separation is accommodated by deforming the square shaped filter-antenna (cavities and coupling apertures) along one axis.

Figure 3:
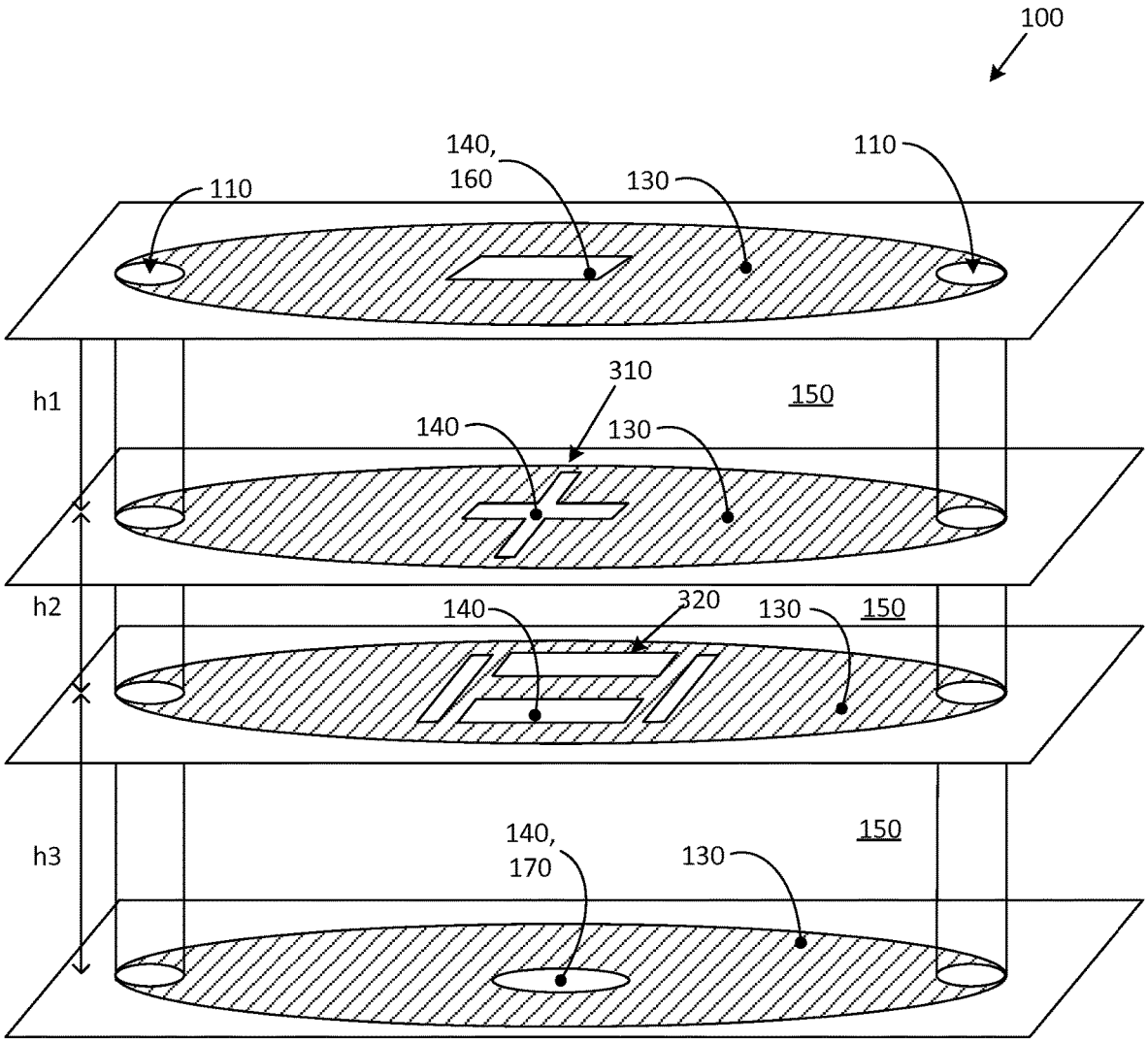

FIG. 3 illustrates a filter arrangement with alternating aperture shapes. According to some aspects, the apertures of two consecutive metallization layers have a centered cross shape 310, and a shape with four slots arranged in a square 320, respectively. This arrangement of alternating between centered cross slots and four peripheral slots suppresses long-ranged coupling between cavities, which is an advantage.

Figure 14:
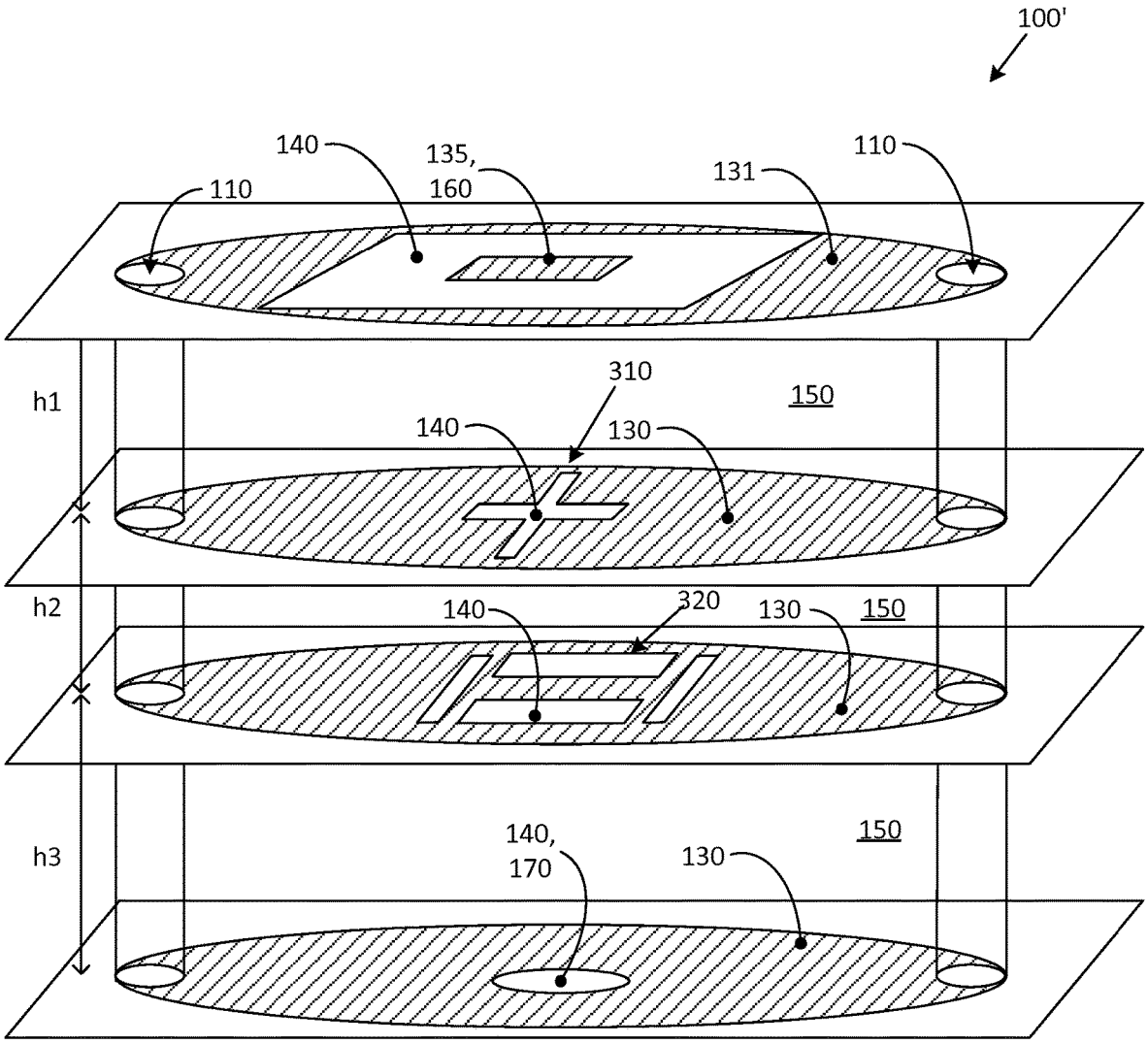
FIG. 14 illustrates a filter arrangement with a patch antenna according to embodiments.

FIG. 14 illustrates a filter arrangement where the aperture of the topmost metallization layer 131 comprises an isolated metal patch 135 arranged as the antenna element 160.

Figure 4:
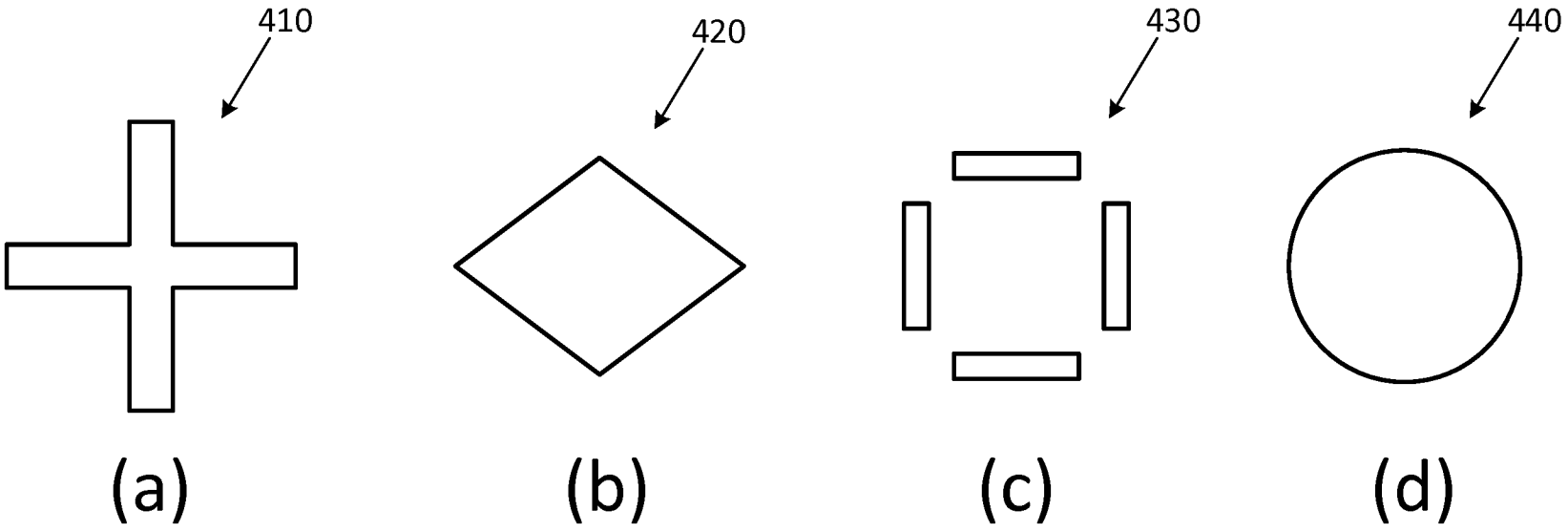
FIG. 4 illustrates example aperture shapes.

FIG. 4 illustrates some example aperture shapes. In general, the filter arrangement according to aspects, displays a geometry which exhibits a 90-degree rotational symmetry. There are many different such aperture shapes to select from. FIG. 4*a* shows a rectangular square shape, FIG. 4*b* shows a diamond-shaped aperture, FIG. 4*c* shows a shape with four slots arranged in a square, and FIG. 4*d* illustrates a round circular aperture shape.

Figure 5:
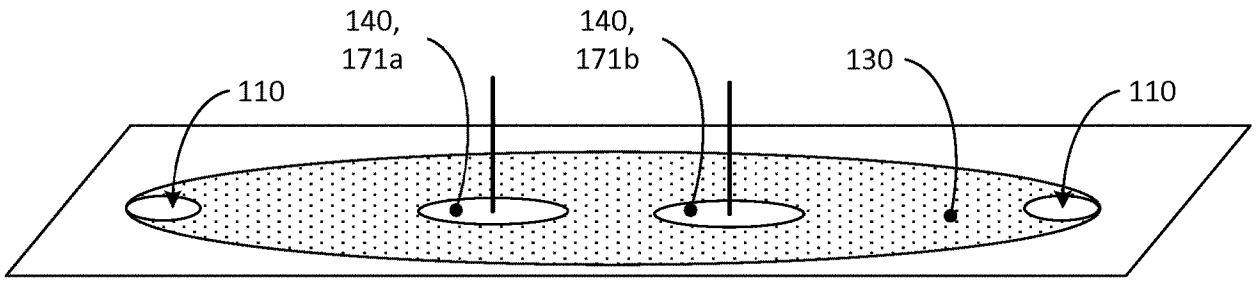
FIG. 5 illustrates apertures used as signal interfaces.
Figure 5:
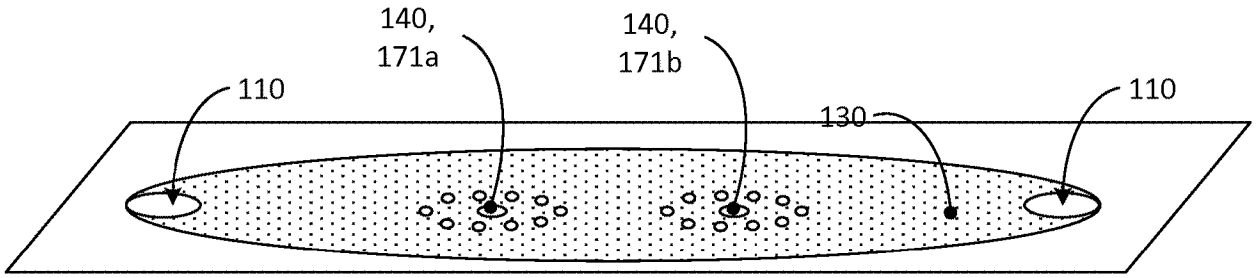

FIG. 5 illustrates apertures used as signal interfaces. FIG. 5*a* illustrates apertures 171*a*, 171*b* realized by coaxial feeds. FIG. 5*b* illustrates how coaxial feeds can be realized using via-holes 171*a*, 171*b*. Other types of transmission lines can be also used to feed the filter, like microstrip lines, coplanar lines, slot lines, etc. This can be useful if the filter with transmission zero is to be realized. In that case the filter must be excited from the cavity above the bottommost one. This calls for need to use a planar transmission lines that can be inserted into a cavity through a side wall.

Figure 6:
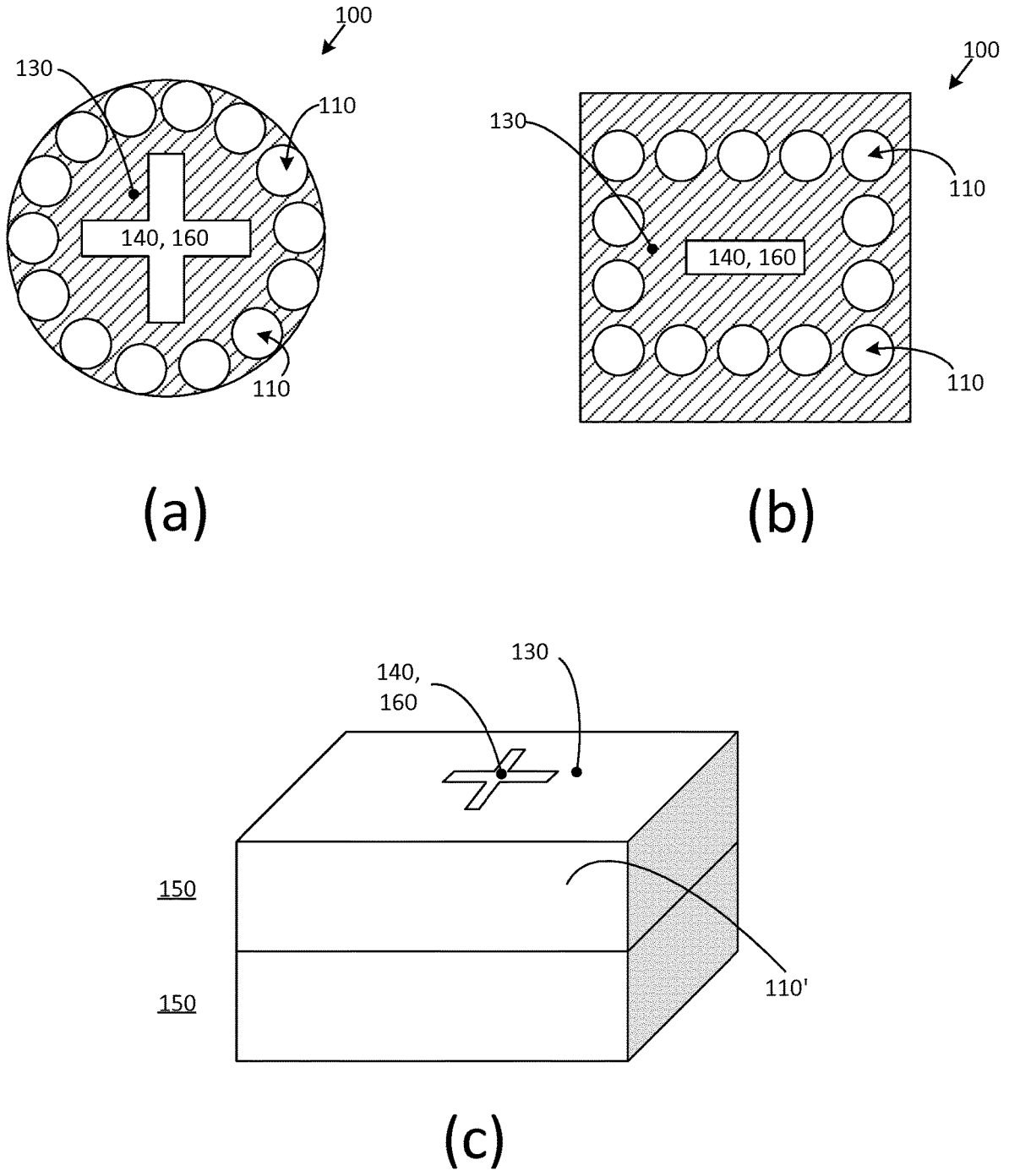
FIG. 6 illustrates apertures used as antenna elements and enclosure side walls.

FIG. 6 illustrates apertures used as antenna elements and enclosure side walls. FIG. 6*a* shows a circular arrangement of via-holes functioning as the electromagnetically shielded side wall. FIG. 6*b* shows an example arrangement of the electromagnetically shielded side wall where via-holes are instead laid out in a rectangular shape on the PCB. FIG. 6*c* illustrates aspects where the electromagnetically shielded side wall comprises a metallized side wall 110'. This metallized side wall may, according to some aspects, comprise a milled trench that has been metallized in order to provide a side wall.

Consequently, according to aspects, the electromagnetically shielded side wall comprises any of; a plurality of via-holes 110, a metallized side-wall 110', and a metallized milled trench 110'.

According to some aspects the electromagnetically shielded side wall comprises a plurality of different shielding components, e.g., a couple of via-holes and one or more sections of metallized milled trench in the PCB.

Figure 7:
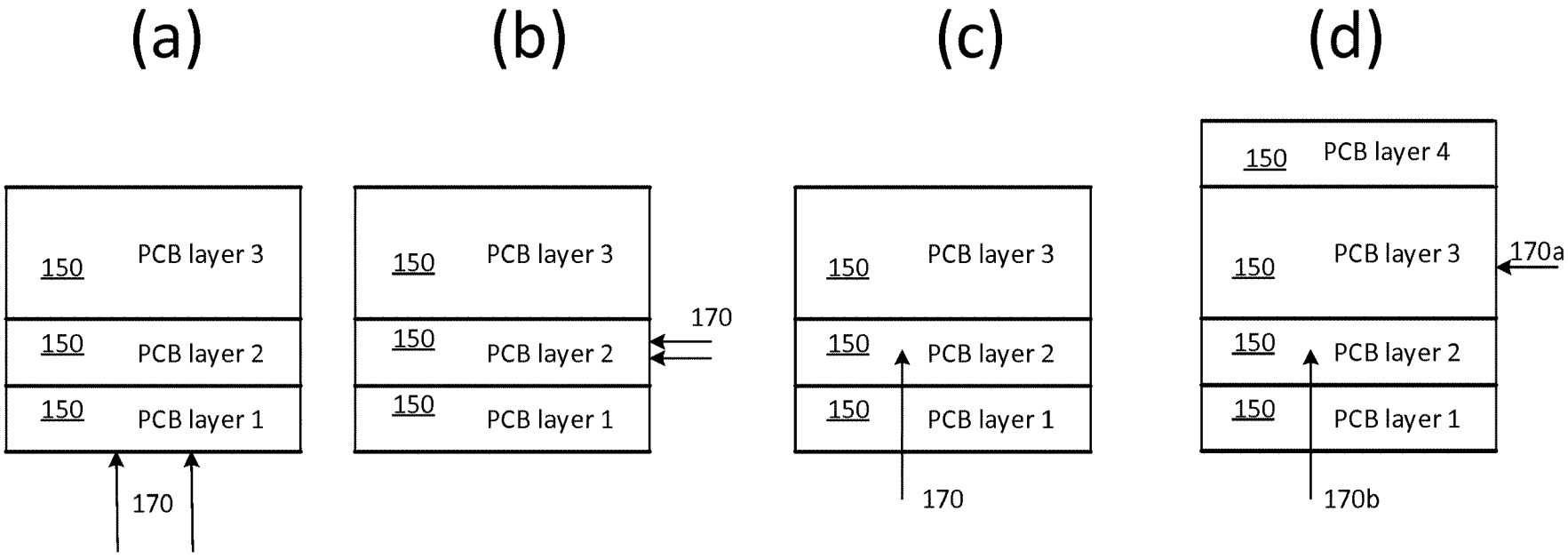
FIG. 7 illustrate example signal feed arrangement.

FIG. 7 illustrate example signal feed arrangement. According to some aspects, the side wall comprises a signal interface 170' arranged as a conduit connecting at least one dielectric material layer to an exterior of the filter arrangement. This conduit may be arranged to connect a bottommost layer or resonance cavity with an exterior of the filter arrangement, as exemplified in FIG. 7*a*. The conduit may also be arranged to connect a resonance cavity within the stack to an exterior, as exemplified in FIG. 7*b* where the second layer, or resonance cavity, from the bottom has been connected to an exterior of the filter arrangement. Such layers inside the stack may also be connected via conduit passing through other layers, such as illustrated in FIG. 7*c*, where PCB layer 2 is arranged with a conduit passing through PCB layer 1. Such conduits may be realized, e.g., by electrical conductor, by waveguide, by traces.

According to some aspects, the signal interface comprises a plurality of signal ports 170*a*, 170*b*. Such a plurality of signal ports may, e.g., be used to feed orthogonally polarized signals to and from the filter arrangement. It can also be used to feed signals of different center frequency or frequency band to and from the filter arrangement.

Figure 8:
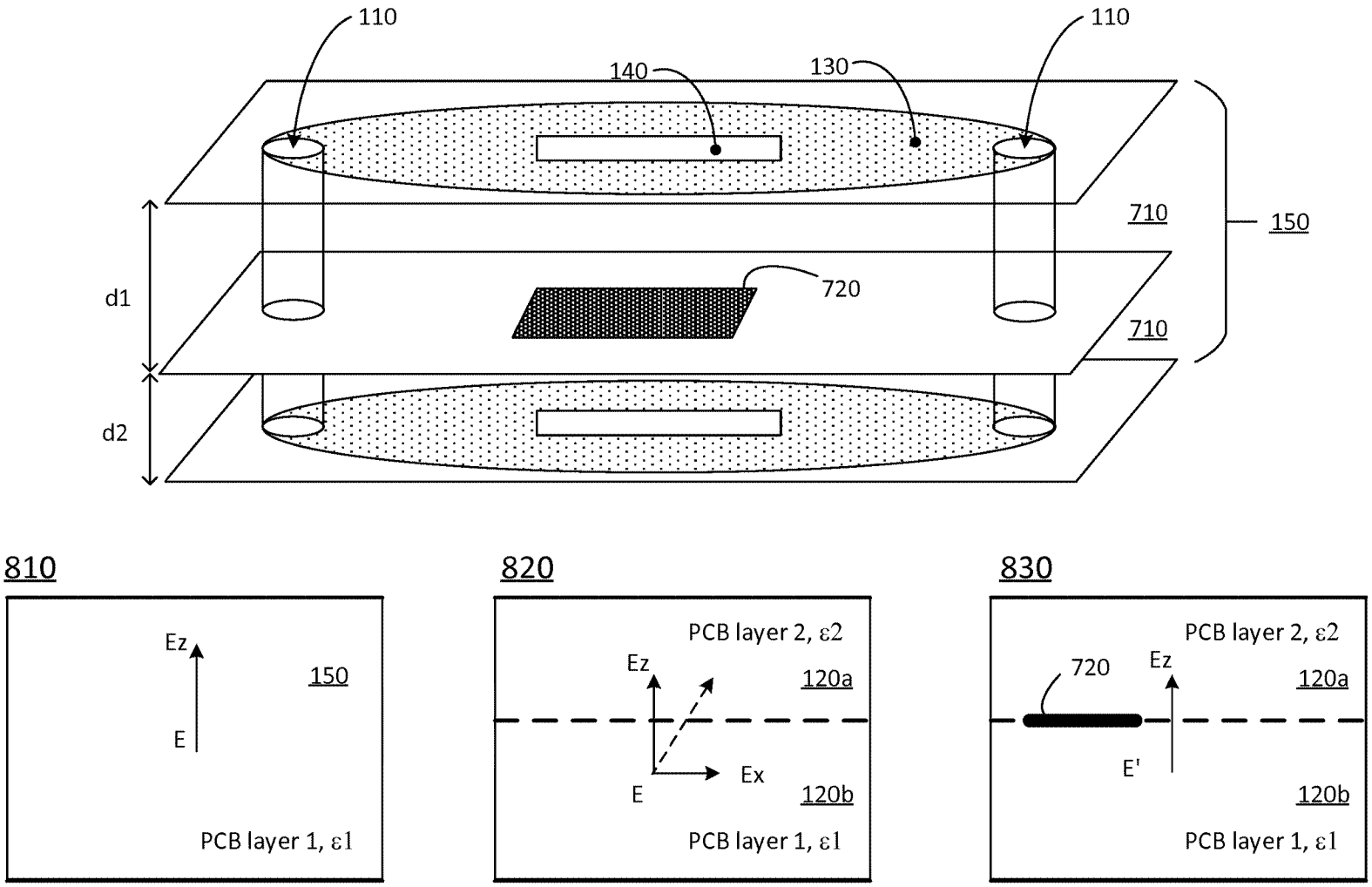
FIG. 8 illustrates PCB sublayers with an interspersed metal patch.

FIG. 8 illustrates PCB sublayers with an interspersed metal patch. According to some aspects, at least one dielectric material layer 150 comprises two or more dielectric sublayers 710 and a metal patch 720 arranged between two of the dielectric sublayers, whereby the dielectric sublayers and the metal patch together determine an effective dielectric constant of the at least one dielectric material layer.

Design of a resonance cavity for use in, e.g., a filter arrangement involves making design choices of parameters of the cavity to achieve a certain desired resonance frequency or overall frequency characteristic or frequency response of the resonance cavity. The dielectric constants and other properties of the first and second layers of dielectric material will affect the resonance frequency of the cavity. The size and shape of the volume delimited by the electromagnetical shielding also contributes to determining the resulting resonance frequency. This is where the limited choices of selectable PCB materials and thicknesses becomes problematic. The discrete options for material and thickness means that only certain resonance frequencies may be obtained for a given enclosed volume. Naturally, such limitation in design is not preferred. However, the metal patch 720 interspersed between layers also affects the resonance frequency, since the shape of the metal patch affects the resonance frequency of the resonance cavity.

Thus, a design process to achieve a preferred resonance frequency of a resonance cavity according to the present disclosure may involve selecting materials and thicknesses for the first and second layer. Given a configuration of the electromagnetic shielding, i.e., the geometrical configuration of the enclosed volume, a resonance frequency is obtained. Materials and thicknesses can be selected to achieve a resonance frequency close to the desired resonance frequency. The shape of the metal patch can then be determined to fine-tune the resonance frequency to the desired value, or within an acceptable range around the desired resonance frequency value. This way, a continuous range is achievable resonance frequencies can be obtained despite limited choices of PCB materials and thicknesses, which is an advantage.

It is appreciated that design of the resonance cavity, i.e., selection of the above-mentioned parameters such as dielectric constants, thicknesses, and metal patch shapes, can be performed using computer simulation, by analytical computation, or by practical experimentation and measurements.

FIG. 8, 810, shows an electric field E along a z-axis in a PCB layer 150. If the layer is divided into sublayers 120*a*, 120*b* as illustrated in FIG. 8, 820, the electrical field is affected causing field components to appear along other axes, here along an x-axis. FIG. 8, 830 illustrates the effects of introducing the metal patch 720. The additional field components are removed, leaving an electric field with different magnitude compared to the field in FIG. 8, 810. Thus, FIG. 8 illustrates the physical effects of introducing a metal patch between two PCB layers of different material.

Figure 9:
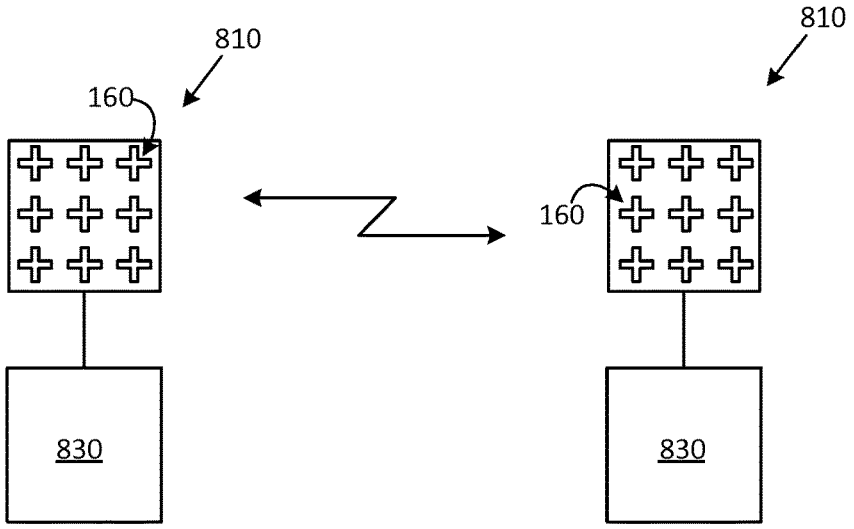
FIG. 9 illustrates network nodes and wireless devices with antenna arrays.
Figure 9:
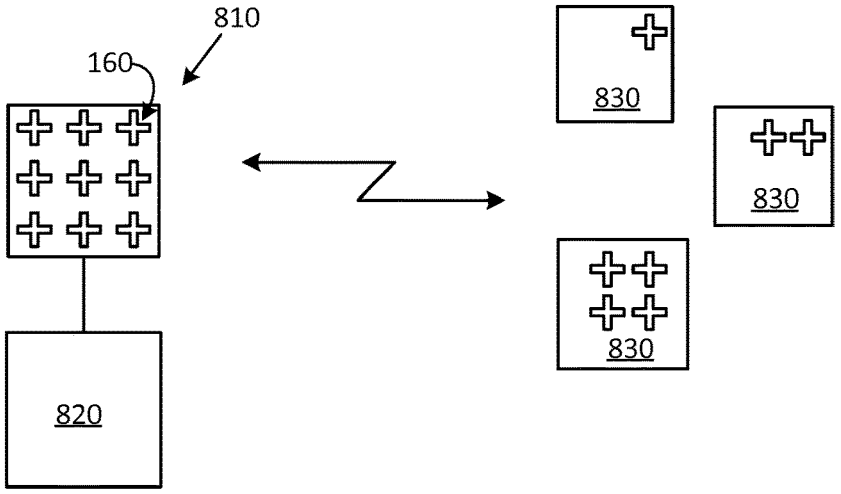

FIG. 9 illustrates network nodes and wireless devices with antenna arrays.

An antenna array 810 comprising a plurality of antenna elements according to claim 12.

A wireless device 830 comprising an antenna element according to claim 12.

FIG. 9 illustrates network nodes and wireless devices with antenna arrays. There is shown antenna arrays 810 comprising a plurality of antenna elements as discussed herein. There is also shown wireless devices 830 comprising one or more antenna elements as discussed herein, and a network node 820 with an antenna array 810.

Figure 10:
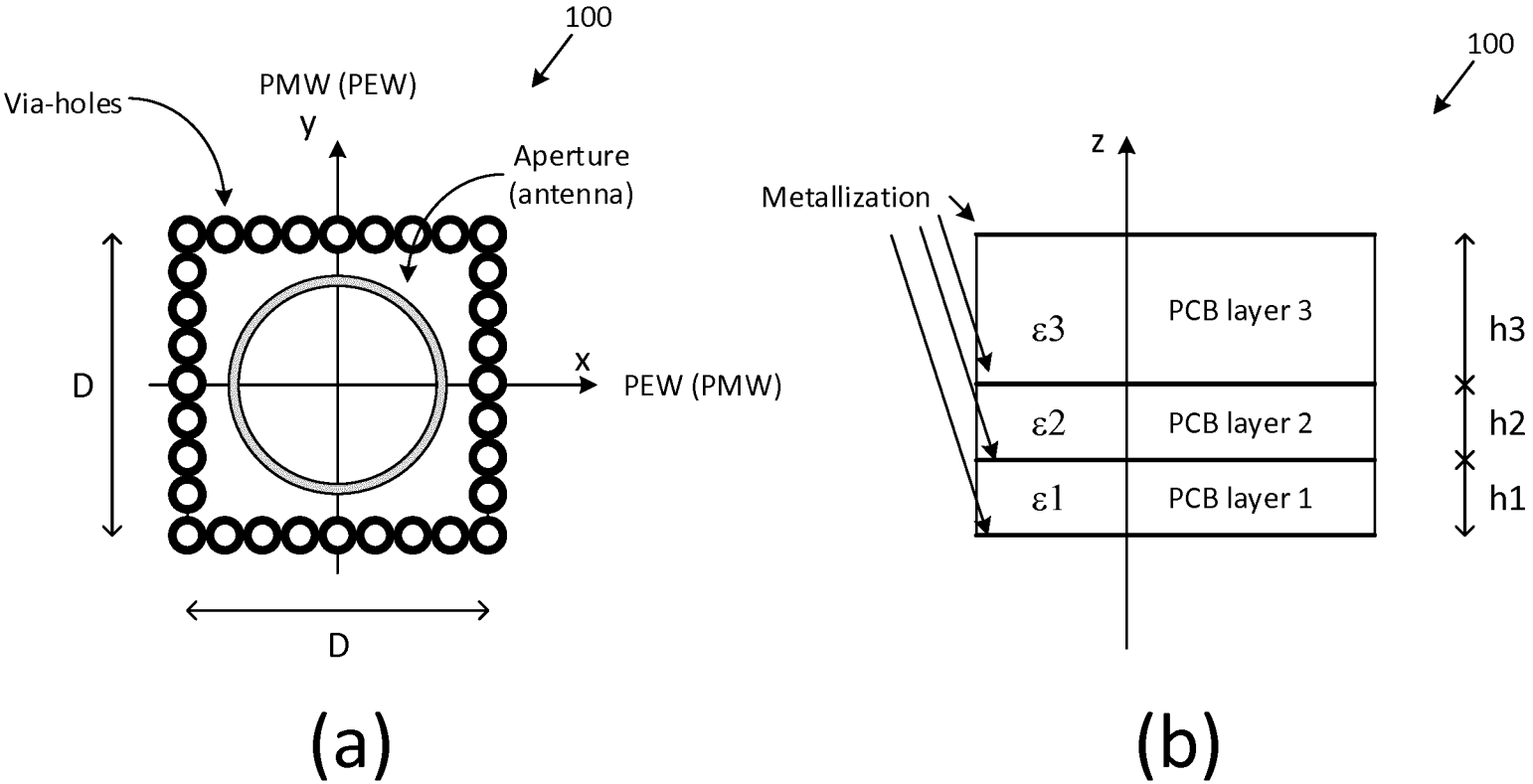
FIG. 10 schematically shows a filter arrangement according to embodiments.

FIG. 10 illustrates a filter arrangement according to embodiments. The filter arrangement comprises three or more metallization layers separated by dielectric material layers, each metallization layer comprising one or more apertures. The filter arrangement comprises an electromagnetically shielded side wall extending through the stacked metallization layers and through the dielectric material layers, whereby the side wall and the metallization layers delimit a cavity in each dielectric material layer. The cavities in two consecutive dielectric material layers being coupled by the aperture in the metallization layer separating the two consecutive dielectric material layers, the aperture of a topmost metallization layer being arranged as antenna element, the aperture of a bottommost metallization layer being arranged as signal interface to the filter arrangement.

It is noted that the filter arrangement can be fed into any of the cavities. If the filter arrangement is fed via a cavity which is not arranged at an end-point of the stack, then a transmission zero will be present in the filter frequency response characteristics.

As mentioned above, there are several advantages of the proposed filter-antenna design shown in FIG. 10, for instance;

Compact size: Two polarization states of the antenna element are realized using TE201 and TE102 degenerate modes. The footprint of the filter is identical to that of the antenna element. Lower insertion loss: The cavities realized using a multilayered substrate stack have higher Q-factor in comparison to any other resonator (microstrip, slot-line, etc.) realized on the same substrate. Using higher order allows even higher Q-factors to be achieved, often by a price of reduced spurious-free window. However, with proper choice of the coupling arrangement there is good potential to keep parasitic passbands at low level.

Reduced sensitivity to the manufacturing tolerances is achieved by choosing a maximum size for the resonant cavities. These are less sensitive in comparison to any other implementation of the resonator.

Response stability: The resonant frequency of each cavity TE210/TE120 is defined by its dimensions in x-y plane, i.e. it is defined by accurate placement of the via holes that establish the cavities side walls. In the proposed filter-antenna design all the resonators are using the same set of via holes. In that follows, that the effect of inaccurate placement of each via hole is identical or very similar for all the resonators. Practical importance of this fact is that the filter-antenna response due to inaccurately placed via holes will be shifted upward or downward on frequency, while return loss performance in the first approach will be not affected.

Bandwidth of the antenna element. A simple way to achieve wide frequency range is to use a cavity backed antenna element as the last resonator and the load for the filter realized in the substrate stack. The design procedure is standard and in this case the filter works as a matching circuit for antenna element. This allows great flexibility when choosing the antenna bandwidth and allows to consider the effect of manufacturing tolerances. Also, a patch antenna in the top-metal layer can give a large antenna bandwidth.

Figure 11:
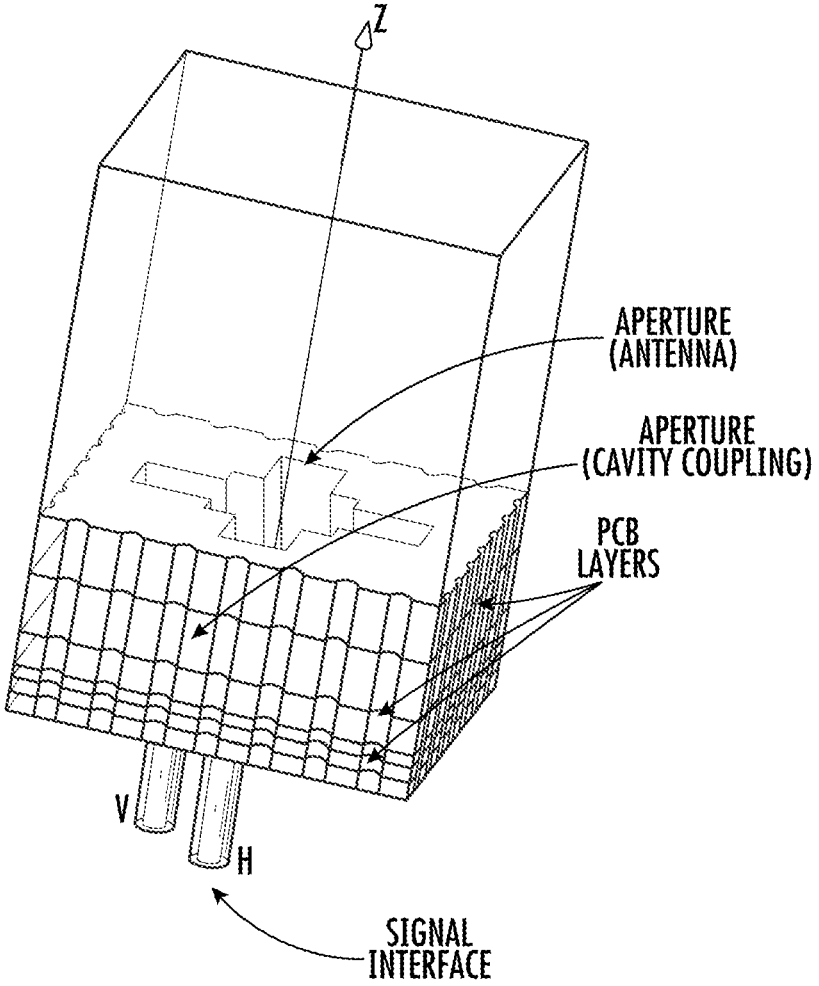
FIG. 11 schematically shows a filter arrangement according to embodiments.

FIG. 11 schematically shows a filter arrangement according to embodiments. FIG. 11 illustrates aspects of a two-port signal interface, several PCB layers used as resonance cavities in a multi-layer stack with apertures coupling neighboring resonance cavities, and an aperture arranged as antenna element according to the present teaching.

Figure 12:
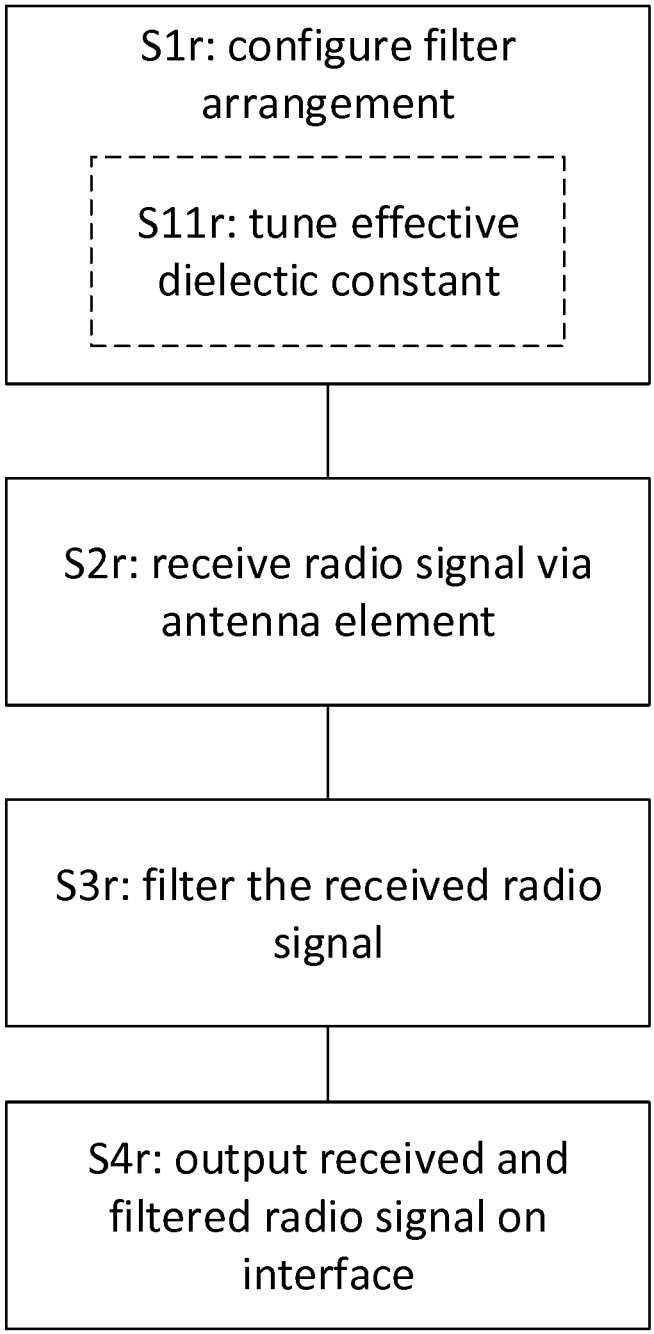
FIGS. 12-13 are flowcharts schematically illustrating methods according to embodiments.

FIG. 12 is a flowchart schematically illustrating a method for receiving a radio signal from a remote transmitter and filtering the radio signal, comprising configuring S1*r* a filter arrangement comprising three or more metallization layers separated by dielectric material layers, each metallization layer comprising an aperture, the filter arrangement comprising an electromagnetically shielded side wall extending though the metallization layers and through the dielectric material layers, whereby the side wall and the metallization layers delimit a cavity in each dielectric material layer, the cavities in two consecutive dielectric material layers being coupled by the aperture in the single metallization layer separating the two consecutive dielectric material layers, receiving S2*r* the radio signal via the aperture of a topmost metallization layer, filtering S3*r* the received radio signal by the coupled cavities, and outputting S4*r* a filtered radio signal via the aperture of a bottommost layer being arranged as signal interface to the filter arrangement.

According to some aspects, the configuring comprises configuring a filter arrangement where at least one dielectric material layer comprises two or more dielectric material sublayers and a metal patch arranged between two of the dielectric material sublayers, and tuning S11*r* an effective dielectric constant of the at least one dielectric material layer by selecting a form and an orientation of the metal patch relative to the dielectric material sublayers.

Figure 13:
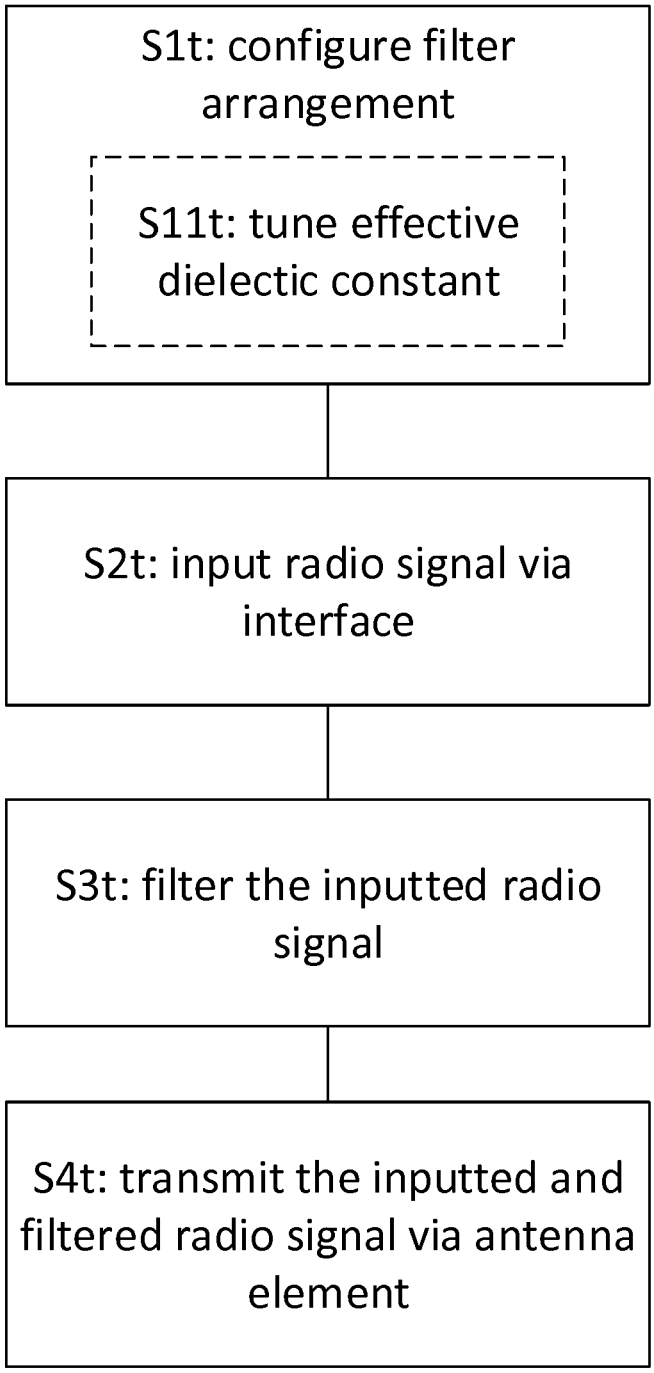

FIG. 13 is a flowchart schematically illustrating a method for filtering a radio signal and transmitting the radio signal to a remote receiver, comprising configuring Sit a filter arrangement comprising three or more metallization layers separated by dielectric material layers, each metallization layer comprising an aperture, the filter arrangement comprising an electromagnetically shielded side wall extending though the metallization layers and through the dielectric material layers, whereby the electromagnetically shielded side wall and the metallization layers delimit a cavity in each dielectric material layer, the cavities in two consecutive dielectric material layers being coupled by the aperture in the single metallization layer separating the two consecutive dielectric material layers, inputting S2t a radio signal via the aperture of a bottommost layer being arranged as signal interface to the filter arrangement, filtering S3*t* the inputted radio signal by the coupled cavities, and transmitting S4*t* the filtered radio signal via the aperture of a topmost metallization layer.

According to some aspects, the configuring comprises configuring a filter arrangement where at least one dielectric material layer comprises two or more dielectric material sublayers and a metal patch arranged between two of the dielectric material sublayers, and tuning Silt an effective dielectric constant of the at least one dielectric material layer by selecting a form and an orientation of the metal patch relative to the dielectric material sublayers.

The invention claimed is:

1. A filter arrangement comprising:

at least three metallization layers separated by dielectric material layers;

an electromagnetically shielded side wall extending though the metallization layers and through the dielectric material layers, the electromagnetically shielded side wall and the metallization layers delimiting a cavity in each dielectric material layer, the cavities in two consecutive dielectric material layers being coupled by at least one aperture in the metallization layer separating the two consecutive dielectric material layers, an aperture of a topmost metallization layer being arranged as antenna element; and a signal interface arranged as a conduit connecting at least one dielectric material layer to an exterior of the filter arrangement, the signal interface comprising a plurality of signal ports arranged to input and to output signals to and from the filter arrangement.

2. The filter arrangement according to claim 1, wherein the aperture of a bottommost metallization layer is arranged as signal interface to the filter arrangement.

3. The filter arrangement according to claim 2, wherein the side wall comprises a signal interface arranged as a conduit connecting at least one dielectric material layer to an exterior of the filter arrangement.

4. The filter arrangement according to claim 1, wherein the side wall comprises a signal interface arranged as a conduit connecting at least one dielectric material layer to an exterior of the filter arrangement.

5. The filter arrangement according to claim 1, wherein the electromagnetically shielded side wall comprises any of:

a plurality of via-holes, a metallized side-wall, and a metallized milled trench.

6. The filter arrangement according to claim 1, wherein a geometry of the filter arrangement exhibits a 90-degree rotational symmetry, and the signal interface comprises a horizontally polarized and a vertically polarized signal port.

7. The filter arrangement of claim 1, wherein the apertures of two consecutive metallization layers have a centered cross shape, and a shape with four slots arranged in a square, respectively.

8. The filter arrangement of claim 1, where each dielectric material layer has a constant thickness and is associated with a corresponding dielectric constant.

9. The filter arrangement of claim 1, wherein at least one cavity supports two TE201 or TE102 degenerate resonance modes.

10. The filter arrangement according to claim 1, wherein at least one dielectric material layer comprises at least two dielectric sublayers and a metal patch arranged between two of the dielectric sublayers, whereby the dielectric sublayers and the metal patch together determine an effective dielectric constant of the at least one dielectric material layer.

11. The filter arrangement according to claim 1, wherein the metallization layers are planar and arranged in parallel with respect to each other.

12. The filter arrangement according to claim 1, wherein the aperture of the topmost metallization layer comprises an isolated metal patch arranged as the antenna element.

13. An antenna element comprising a filter arrangement, the filter arrangement comprising:

at least three metallization layers separated by dielectric material layers;

an electromagnetically shielded side wall extending though the metallization layers and through the dielectric material layers, the electromagnetically shielded side wall and the metallization layers delimiting a cavity in each dielectric material layer, the cavities in two consecutive dielectric material layers being coupled by at least one aperture in the metallization layer separating the two consecutive dielectric material layers, an aperture of a topmost metallization layer being arranged as antenna element; and a signal interface arranged as a conduit connecting at least one dielectric material layer to an exterior of the filter arrangement, the signal interface comprising a plurality of signal ports arranged to input and to output signals to and from the filter arrangement.

14. The antenna element according to claim 13, wherein there are a plurality of antenna elements, the plurality of antenna elements being arrangement to form an antenna array.

15. The antenna element according to claim 13, wherein the antenna element is part of a wireless device.

16. A method for receiving a radio signal from a remote transmitter and filtering the radio signal, the method comprising:

configuring a filter arrangement comprising at least three more metallization layers separated by dielectric material layers, each metallization layer comprising an aperture, the filter arrangement comprising an electromagnetically shielded side wall extending though the metallization layers and through the dielectric material layers, the electromagnetically shielded side wall and the metallization layers delimiting a cavity in each dielectric material layer, the cavities in two consecutive dielectric material layers being coupled by the aperture in the single metallization layer separating the two consecutive dielectric material layers;

receiving the radio signal via the aperture of a topmost metallization layer;

filtering the received radio signal by the coupled cavities; and outputting a filtered radio signal via the aperture of a bottommost layer being arranged as a signal interface to the filter arrangement, the signal interface comprising a plurality of signal ports arranged to input and to output signals to and from the filter arrangement.

17. The method of claim 16, wherein the configuring comprises configuring a filter arrangement where at least one dielectric material layer comprises at least two dielectric material sublayers and a metal patch arranged between two of the dielectric material sublayers, and tuning an effective dielectric constant of the at least one dielectric material layer by selecting a form and an orientation of the metal patch relative to the dielectric material sublayers.

18. A method for filtering a radio signal and transmitting the radio signal to a remote receiver, the method comprising:

configuring a filter arrangement comprising at least three metallization layers separated by dielectric material layers, each metallization layer comprising an aperture, the filter arrangement comprising an electromagnetically shielded side wall extending though the metallization layers and through the dielectric material layers, the electromagnetically shielded side wall and the metallization layers delimiting a cavity in each dielectric material layer, the cavities in two consecutive dielectric material layers being coupled by the aperture in the single metallization layer separating the two consecutive dielectric material layers;

inputting a radio signal via the aperture of a bottommost layer being arranged as signal interface to the filter arrangement, the signal interface comprising a plurality of signal ports arranged to input and to output signals to and from the filter arrangement;

filtering the inputted radio signal by the coupled cavities; and transmitting the filtered radio signal via the aperture of a topmost metallization layer.

19. The method of claim 18, wherein the configuring comprises configuring a filter arrangement where at least one dielectric material layer comprises at least two dielectric material sublayers and a metal patch arranged between two of the dielectric material sublayers, and tuning an effective dielectric constant of the at least one dielectric material layer by selecting a form and an orientation of the metal patch relative to the dielectric material sublayers.

* * * * *